United States Patent [19]

Iimori

[11] Patent Number: 4,589,760

[45] Date of Patent: May 20, 1986

[54] IMAGE FORMING APPARATUS

[75] Inventor: Akiro Iimori, Yokohama, Japan

[73] Assignee: Tokyo Shibaura Denki Kabushiki Kaisha, Kawasaki, Japan

[21] Appl. No.: 524,778

[22] Filed: Aug. 19, 1983

[30] Foreign Application Priority Data

Aug. 31, 1982 [JP] Japan ..... 57-150965

[51] Int. Cl.[4] ..... G03G 15/04

[52] U.S. Cl. ..... 355/8

[58] Field of Search ..... 355/3 R, 8, 14 R

[56] References Cited

U.S. PATENT DOCUMENTS

| | | | |
|---|---|---|---|
| 3,512,886 | 5/1970 | Wirley et al. | 355/8 X |
| 4,183,660 | 1/1980 | Bujese | 355/8 X |
| 4,256,399 | 3/1981 | Ikeda | 355/8 |
| 4,270,857 | 6/1981 | Komori et al. | 355/8 |
| 4,344,696 | 8/1982 | Murata et al. | 355/8 |

FOREIGN PATENT DOCUMENTS 2547355 10/1975 Fed. Rep. of Germany .

2917194 4/1979 Fed. Rep. of Germany .

OTHER PUBLICATIONS

Patent Office Action (German) dated Oct. 5, 1984–S.N. P 33 31 455.1-51—applicant Tokyo Shibaura Denki K.K. (with translation).

*Primary Examiner*—Fred L. Braun

*Attorney, Agent, or Firm*—Cushman, Darby & Cushman

[57] ABSTRACT

An image forming apparatus is provided with spring clutches designed to transmit a driving force to a chain by being selectively actuated, whereby a document table is allowed to move at first or second speeds in accordance with the travel of the chain. The image forming apparatus has a microcomputer or controller for controlling first and second spring clutches through solenoids. The controller is provided for changing from the first speed to the second speed, while ensuring that the first spring clutch remains actuated for a predetermined time after the second spring clutch has been actuated.

7 Claims, 17 Drawing Figures

IMAGE FORMING APPARATUS

BACKGROUND OF THE INVENTION

This invention relates to an image forming apparatus and, more particularly, to an image forming apparatus designed such that the document table is allowed to make its reciprocating movement in accordance with the running of a chain.

In a conventional copying machine, the document table is required to be moved at a low and unvaried speed at the time of exposure. For example, after a document is subjected to a light exposure in a forward stroke of the document table, the document table is moved at high speed in its backward stroke in order to shorten a copy cycle. Thus the copying machine is usually equipped with at least two spring clutches, one for a low speed mode and the other for a high speed mode, and the clutch operation is performed to transmit a driving force to the chain through a selected one of the clutches.

However, the spring clutch has a response time from receipt of a start instruction to reliable transmission of a driving power that is longer than the response time for receipt of a stop instruction. For this reason, when, at the time of switching the movement of the document table from its forward stroke to its backward stroke, the stop and start instructions are simultaneously applied to the low and high speed clutches respectively, the chain runs temporarily without sufficient power from either spring clutch. For this reason, for example, pressing the document, e.g., a thick book, on the document table by hand would cause a displacement of the document table due to the pressing force, causing a miscopy.

Most of the prior art copying machines, therefore, adopt the following system for the purpose of preventing such an idle displacement of the document table. That is, whenever the document table is moved, the spring clutch for low speed is actuated, and, in a state wherein a driving force is supplied to the chain, a start instruction or stop instruction for change-over of the speed is applied to the spring clutch for high speed only. In this system, since driving force is supplied by the spring clutch for low speed to the chain during a period of time in which a sufficient power is not transmitted to the chain by the spring clutch for high speed, no idle movement occurs in the document table. Thus, when the spring clutch for high speed is actuated, the chain falls under the control of this spring clutch and is thus allowed to travel at high speed.

In such a system, however, since a large load is applied to the spring clutch for low speed, the service life of the same is shortened. Further, while control of a copying operation required knowledge of the position and the direction of movement of the document table, it was impossible with the prior art copying machine to know the direction of table movement by the use of the magnets mounted on the document table.

SUMMARY OF THE INVENTION

In view of the above, the object of the present invention is to provide an image forming apparatus which can prevent the document table from making idle travel without applying a large load to the spring clutch.

The object can be achieved by an image forming apparatus which comprises a drive source section for generating driving forces, a document table on which a document is disposed and which is reciprocatingly movable, a spring clutch mechanism having an input stage connected to said drive source section and an output stage, for selectively transmitting the driving forces of said drive source section from said input stage to said output stage under either one of a first and a second speed mode, a document-table reciprocating mechanism connected to said output stage of said spring clutch mechanism for reciprocating said document table by the use of a driving force transmitted to said output stage, a table position detecting unit for detecting at least one position of said document table kept in motion and outputting at least one position detecting signal, a clutch driving circuit for selectively supplying to said spring clutch means first and second driving signals to drive said spring clutch means under said first and second speed modes and supplying in response to the position detecting signals from said table position detecting unit said first and second driving signals to said spring clutch mechanism on an overlapping basis exclusively during a prescribed period of time corresponding at least to a response time of said spring clutch means and driving said spring clutch mechanism under both said first and second speed modes exclusively during said prescribed period of time, a photoconductive member, an exposing section for permitting the formation of a latent image corresponding to a pattern of the document onto said photoconductive member, a developing section for changing said latent image into a visible image, a transferring section for transferring the visible image of said photoconductive member onto a sheet of paper, and a fixing section for fixing the visible image thus transferred onto the sheet of paper.

DETAILED DESCRIPTION OF THE PREFERRED EMBODIMENT

Figure 1:
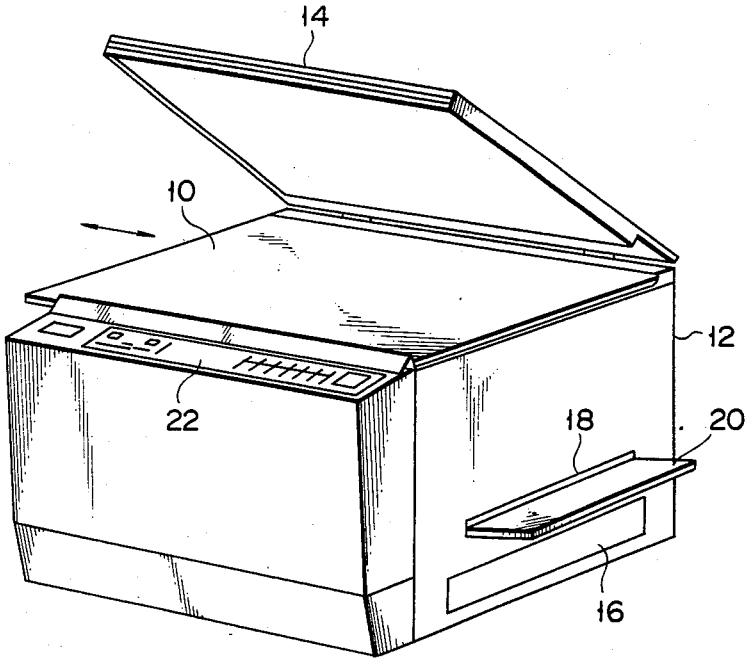
FIG. 1 is a perspective view of the image forming apparatus according to an embodiment of the invention.

As shown in FIG. 1, a document table 10 allowed to slide with a document loaded thereon in directions indicated by an arrow is provided on the upper portion of an image forming apparatus. This document table 10 has a transparent glass plate, on which a provided cover 14 is openable. A paper cassette having a plurality of copying papers therein is inserted into a paper cassette inlet 16 formed in the side portion of a cabinet 12 of the image forming apparatus. At a position located above this paper cassette inlet 16, there is provided a manual paper feeder inlet 18, into which the copying papers are inserted on sheet by sheet basis, and which has a paper guide 20 protruded outside said side portion of the cabinet 12. In the side portion of the cabinet 12 opposite to that at which the inlets 16 and 18 are provided, there is provided a paper outlet from which a copied paper is discharged. A control panel 22 is provided on the front upper surface of the cabinet 12.

Figure 2:
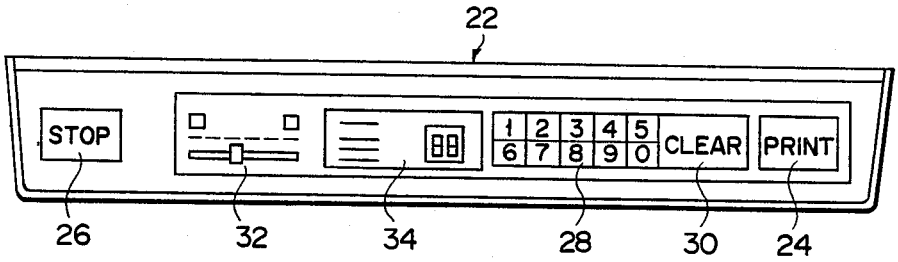
FIG. 2 is a plan view of a control panel of the image forming apparatus shown in FIG. 1.

As shown in FIG. 2, the control panel 22 includes information display 34 and command inputs such as a print key 24, stop key 26, copies number setting ten-key 28, copies number clear key 30, and a copy concentration setting knob 32. The information display 34 displays, for example, "Wait", "Ready to copy", "Paper should be supplementarily fed", "Toner short", "Paper jammed", "Toner pack should be replaced", and a value set by the copies number setting ten-key 28.

Figure 3:
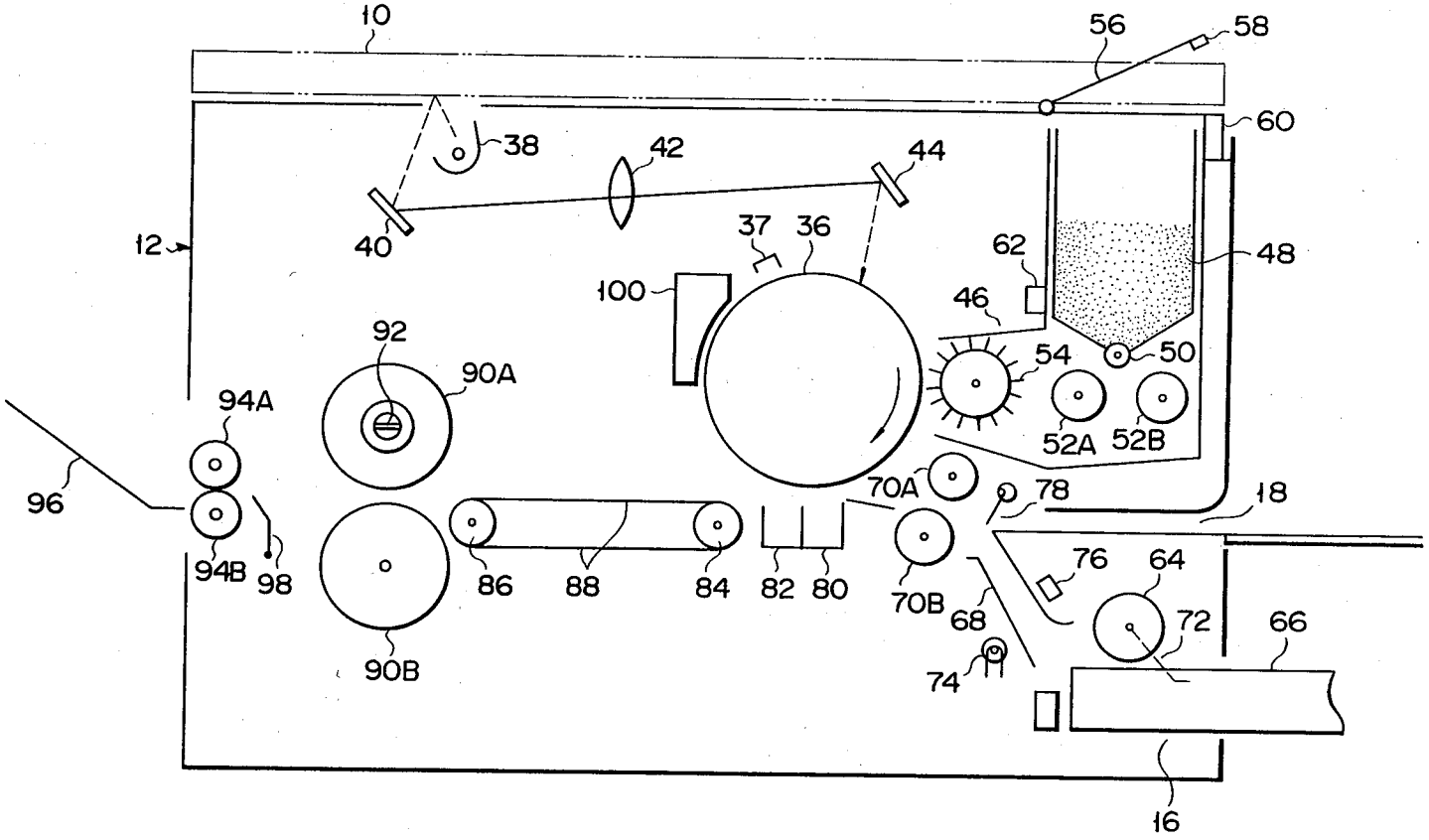
FIG. 3 is a view schematically showing an internal mechanism of the image forming apparatus of FIG. 1.

As shown in FIG. 3, beneath the document table 10, an exposure unit is provided to expose a photoconductive drum 36 provided at a substantially central part of the cabinet 12. This exposure unit is comprised of an exposure lamp 38, reflector mirror 40, optical lens 42, and reflector mirror 44. The photoconductive drum 36 is allowed to rotate in accordance with the movement of the document table, and, when the photoconductive drum is exposed by means of the exposure unit, an electrostatic latent image corresponding to an image of the document is formed on the surface of the photoconductive drum 36. The developer 46 includes a toner hopper 48, toner feeding roller 50, toner stirring rollers 52A, 52B and a developing roller 54. The developing roller 54 acts to change the electrostatic latent image into a visible toner image by supplying the toner of the toner hopper 48 to this electrostatic latent image. The toner hopper 48 has a lid opening/closing sensor which is comprised of a magnet 58 attached to an openable lid 56 and a reed switch 60 attached to a toner case and a toner absence sensor 62. A pick-up roller 64 of the paper feeder takes out a copying paper from a paper cassette 66 on sheet by sheet basis and supplies the copying paper between a pair of aligning rollers 70A and 70B through a guide 68. A switch 72 for sensing the absence of the copying paper is mounted to the pick-up roller 64. At an inlet portion of the guide 68, there is provided a paper detector comprised of a light emitting element 74 and a light receiving element 76, located opposite each other. The paper detector detects the presence or absence of the copying paper in accordance with a variation in the amount of light received by the light receiving element 76. The aligning rollers 70A and 70B align the copying paper supplied thereto from the paper cassette 66 or manual paper feeder inlet 18 and then convey the copying paper into a transfer section. In the paper passage of the manual paper feeder, there is provided a switch 78 for sensing that the copying paper has been manually fed. A transfer charger 80 of the transfer section transfers the toner image on the surface of the photoconductive drum 36 onto a paper carried into the transfer section by the aligning rollers 70A and 70B. A separating charger 82 separates the paper thus transferred from the photoconductive drum 36. A conveyor belt 88 is stretched between a pair of conveying rollers 84 and 86. A pair of heat rollers 90A and 90B sandwich the paper carried thereto from the separating charger 82 through the conveyor belt 88 and allow the same to pass therethrough. At this time, the toner image on the paper is fixed by the heat of a heater lamp 92. A pair of paper discharge rollers 94A and 94B discharge the fixed paper or copy carried from the heat rollers 90A and 90B, into a tray 96. At the vicinity of the paper discharge rollers 94A and 94B, there is provided a switch 98 for detecting the discharge of the copy. At a position above the periphery of the photoconductive drum 36, there is provided a cleaner 100, which is arranged to recover the toner remaining on the surface of the photoconductive drum 36. This cleaner 100 has a switch (not shown) for detecting that the cleaner 100 is full of toner.

Figure 4:
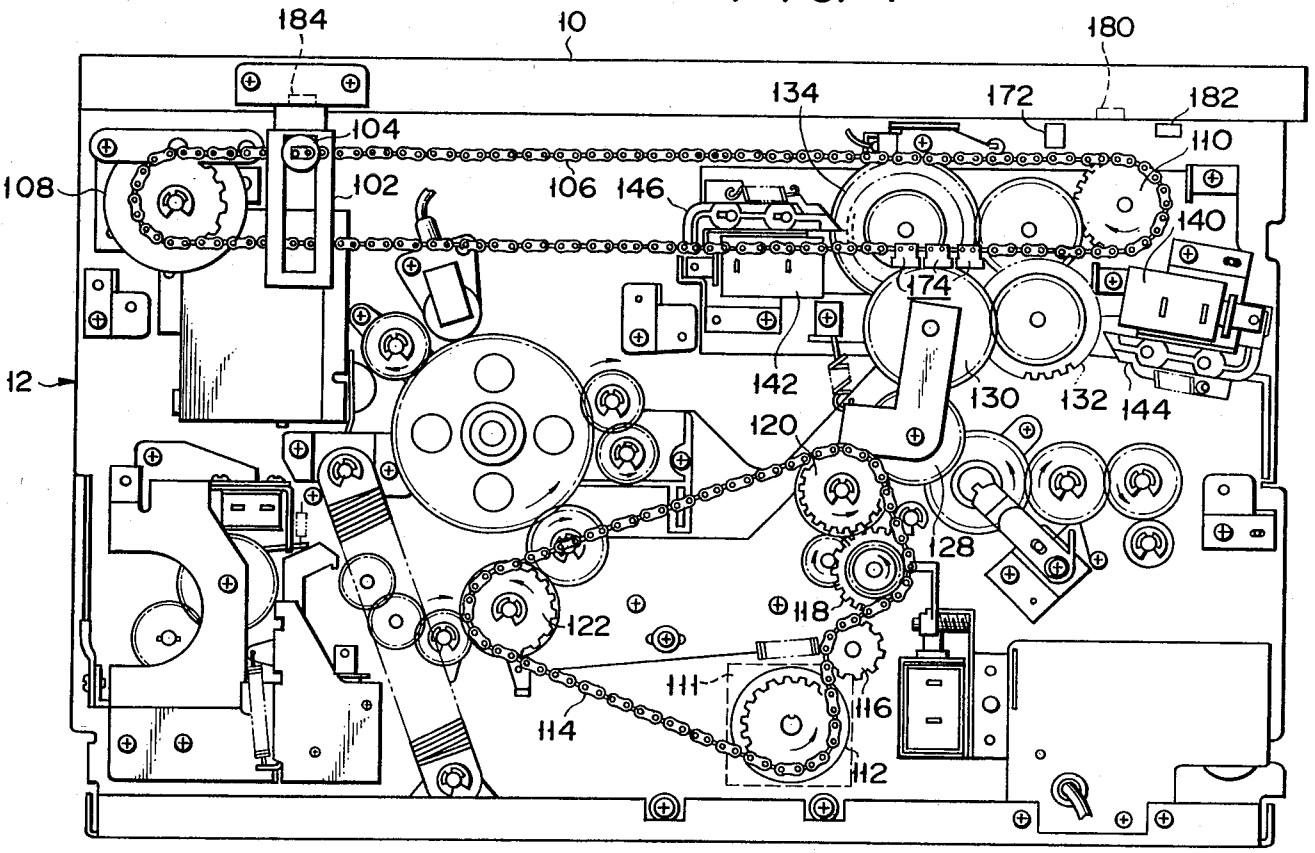
FIG. 4 is a view schematically showing a document table reciprocating mechanism of the image forming apparatus of FIG. 1.
Figure 5:
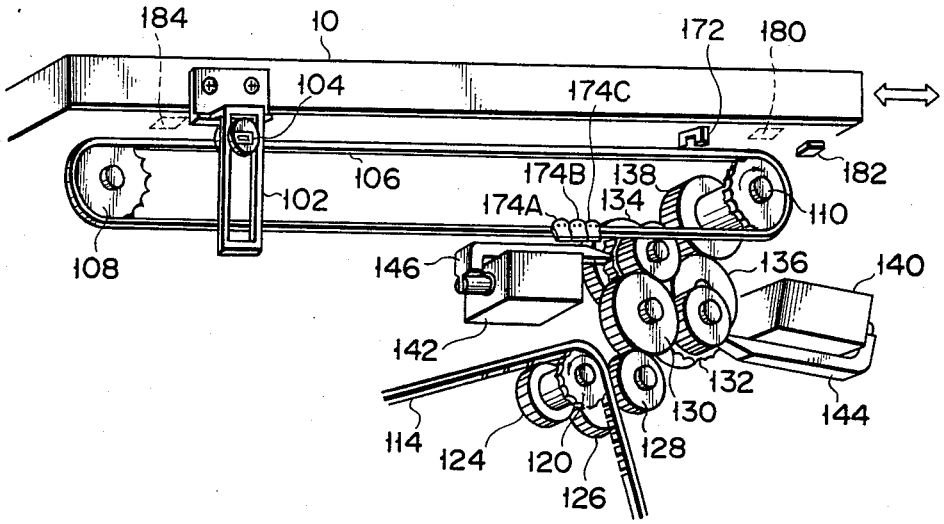
FIG. 5 is a perspective view showing a main part of the document table reciprocating mechanism shown in FIG. 4.
Figure 6:
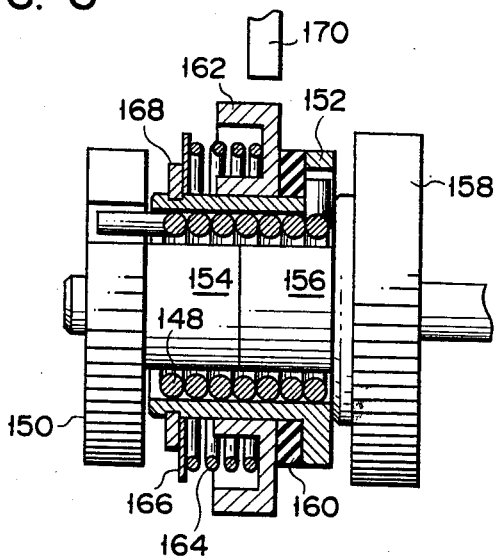
FIG. 6 is a sectional view of a spring clutch incorporated into the apparatus.

According to the document table transferring mechanism shown in FIG. 4, a binder 102 is attached to a side portion of the document table 10. This binder 102 is connected to a chain 106 by means of a pin 104 which is vertically slidable within a frame. The chain 106 is bridged or stretched over a pair of sprockets 108 and 110. Further, a shaft of a motor 111 serving as a drive source is attached to a sprocket 112 located in a lower portion of the cabinet 12. The sprocket 112 is connected to sprockets 116, 118, 120, 122 by means of a chain 114. The sprocket 120 is attached to a gear 124 in a shaft to shaft relationship as shown in FIG. 5. The gear 124 is meshed with a gear 126, which is attached to a gear 128 in a shaft to shaft relationship. A gear 130 meshed with the gear 128 is further meshed with the respective input gears of spring clutches 132 and 134. The output gears of the spring clutches 132 and 134 are meshed with a gear 136, which is meshed with a gear 138 attached to the sprocket 110 in a shaft to shaft relationship. Solenoids 140 and 142 are located in the vicinity of the spring clutches 132 and 134, respectively. Respective plungers 144 and 146 of the solenoids 140 and 142 have their stopping pawls operatively engaged with respective ratchet gears of the spring clutches 132 and 134, respectively. The number of output gears of the spring clutch 134 is greater than the number of output gears of the spring clutch 132. Except for this difference, both the spring clutches 132 and 134 are the same in structure. A detailed structure of the spring clutch 132 is shown in FIG. 6.

A clutch spring 148 has one end anchored in the input gear 150 and the other end held in place by a sleeve 152 mounted thereover. There is a clearance between the inner surface of the clutch spring 158 and the outer surface of both input and output gear bosses 154 and 156. The output gear 158, therefore, can rotate in either direction completely freely of the clutch spring when the clutch is not engaged. A brake pad 160, ratchet gear 162, compression spring 164 and washer 166 are mounted on the sleeve 152 and are held in place by a C-ring 168. The ratchet gear 162 is frictionally connected to the sleeve 152 via the brake pad 160 and compression spring 164. The stopper pawl 170 is so arranged as to engage with or disengage from the ratchet gear 162 when the solenoid 140 (See FIG. 5) is energized or de-energized.

Assume now that the input gear 150 is counter-clockwise rotated but that the solenoid 140 is not yet energized. Then, the driving force of the input gear 150 is not transmitted to the output gear 158 due to the clearance between the clutch spring 148 and the output gear boss 156. However, when the solenoid 140 is energized and the ratchet gear 162 is engaged by the stopper pawl 170, the ratchet gear 162 is forced to stop rotating and applies a frictional braking force to the sleeve 152. When the sleeve 152 is stopped, the clutch spring 148 which is anchored in the sleeve 152 constricts and grips both the input and output gear bosses 154 and 156, and the input drive force is transmitted to the output gear 158. When the solenoid 140 is deenergized to permit the pawl 170 to disengage from the ratchet, the above griping condition is terminated and the clutch spring 148 expands with the result that the output gear 158 is released.

That is, when the motor as a drive source is started, the sprocket 112 is allowed to rotate in a direction indicated by the arrow. This rotational force is transmitted to the input gears of the spring clutches 132 and 134 through the chain 114, sprocket 120, and the gears 124, 126, 128 and 130 in the order mentioned. When, at this time, the stopping pawl of the plunger 144 is engaged, under the control of the solenoid 140, with the ratchet gear of the spring clutch 132, for example, this clutch transmits the drive force of its input gear to the output gear. The drive force of the output gear of the spring clutch 132 is transmitted to the sprocket 110 through the gears 136 and 138, to allow the chain 106 to travel at a low speed in a direction indicated by the arrow. Thus, the document table 10 is allowed to move at a low speed in accordance with the rate of travel of the chain 106 through the sectional region between the sprockets 108 and 110.

On the other hand, when the stopper pawl of the plunger 146 is engaged, under the control of the solenoid 142, with the ratchet gear of the spring clutch 134, this clutch permits the chain 106 to travel at a high speed through the gears 136, 138 and the sprocket 110 in that order in the same direction as indicated by the arrow. As a result, the document table is allowed to move at a high speed.

Figure 7A:
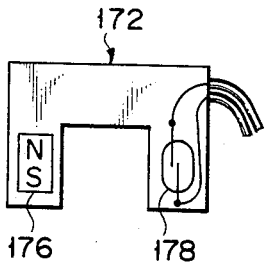
FIG. 7A is a view showing the schematic structure of a home switch assembly.
Figure 7B:
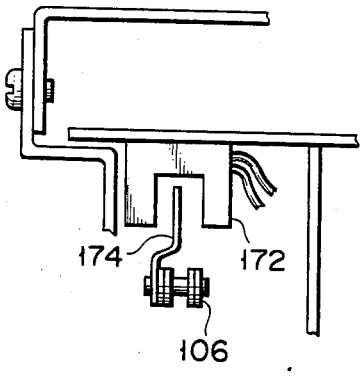
FIG. 7B is a view showing a positional relationship between the home switch section and metallic shielding plates when an open signal is generated.

The image forming apparatus, as a copying machine, has a switch mechanism for sensing the position of the document table 10, said switch mechanism being comprised of first, second and third switch mechanism. The first switch mechanism is comprised of a home switch assembly 172 and metallic shielding plates 174A, 174B and 174C, and is designed to detect whether or not the document table 10 is located at a prescribed home position when the apparatus is waiting for a printing command. As shown in FIG. 4 or 5, the home switch assembly 172 is mounted, in a position near the sprocket 110 where the chain 106 vibrates less, to a portion of the cabinet corresponding to the chain 106. The switch assembly 172 is constructed of a magnet 176 and a reed switch 178 both of which take a concave form shown in FIG. 7 opposing each other. The shielding plates 174A, 174B and 174C are attached to the chain 106 in such a manner that, when the document table 10 is located at the home position, they are interposed between the magnet 176 and the reed switch 178 of the home switch assembly 172. That is, the reed switch 178 is normally closed by the magnetic force of the magnet 176 and is opened when the shielding plates 174A, 174B and 174C are carried into the interspace between the magnet 176 and the reed switch 178 of the home switch assembly 172 in accordance with the travel of the chain 106 which interrupts the magnetic force of the magnet 176. The second switch mechanism is comprised of a magnet 180 and a reed switch 182, and is arranged to detect whether or not the document table 10 is located at a paper start position wherein the aligning rollers 70A and 70B commence operating. The reed switch 182 is mounted, at a position near the sprocket 110, to the cabinet 12 opposite the document table 10. The magnet 180 is mounted to the bottom surface of the document table 10 at the forward side thereof, and closes the reed switch 182 when it reachs a position above the reed switch 182 in accordance with the movement of the document table 10. The third switch mechanism is comprised of a magnet 184 and the said reed switch 182, and is arranged to detect if the document table is located just in front of the forward limit position. The magnet 184 is mounted to the bottom surface of the document table 10 at the backward side thereof and closes the reed switch 182 in the same manner as in the case of the magnet 180.

Figure 8:
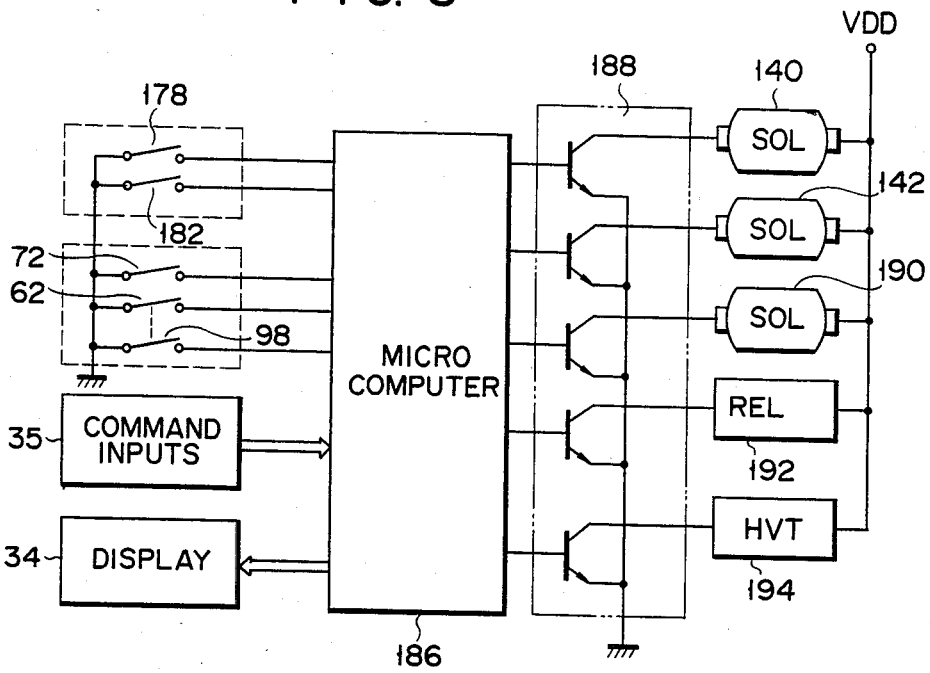
FIG. 8 is a circuit diagram of a control circuit for controlling the image forming apparatus shown in FIG. 1.

FIG. 8 shows a control circuit for controlling this image forming apparatus. This control circuit has a microcomputer 186 containing a memory therein which is used to store a program for controlling the copying mechanism and the document table transferring mechanism in response to the commands from the control panel 22. This microcomputer 186 is connected to the paper absence detecting switch 72, toner absence sensor 62, etc., and is supplied with signals representing various operations of the apparatus. Further, the microcomputer 186 is connected to the control panel 22, and is inputted with various commands regarding copying operations supplied from the copy number setting tenkey 28, print key 24, etc. of the control panel 22. Further, the microcomputer 186 is connected to the reed switches 178 and 182, and is supplied with the position information concerning the document table 10 which is necessary for continuous copying operation. An output end of the microcomputer 186 is connected to solenoids 140, 142, and 190, relay 192, high voltage charged transformer 194, etc. through a driver circuit 188. The microcomputer 186 controls the solenoids 140 and 142 to activate the above-mentioned spring clutches 130 and 132. The relay 192 serves, for example, as a starting switch for the motor. The solenoid 190 controls, for example, a paper feeding spring clutch.

The operation of the image forming apparatus having the foregoing construction will now be described with reference to the views of FIGS. 9A to 9F showing the position of the document table 10 as well as the flow charts of FIGS. 10A and 10B.

Figure 9A:
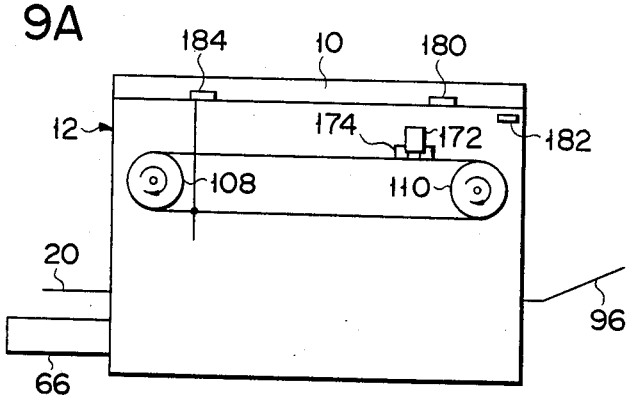
FIGS. 9A to 9F show the movement positions of the document table.
Figure 9B:
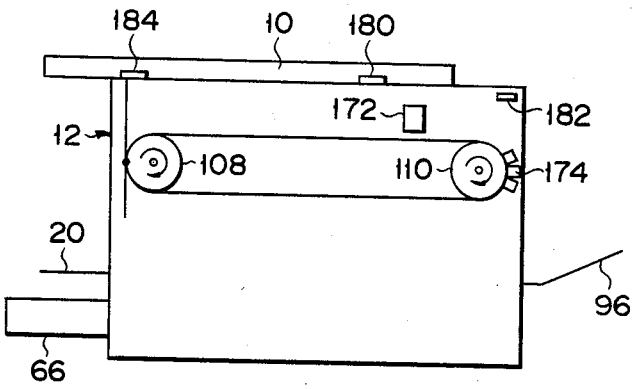
Figure 9C:
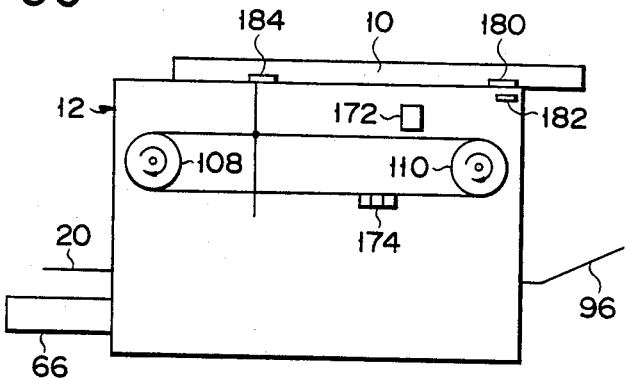
Figure 9D:
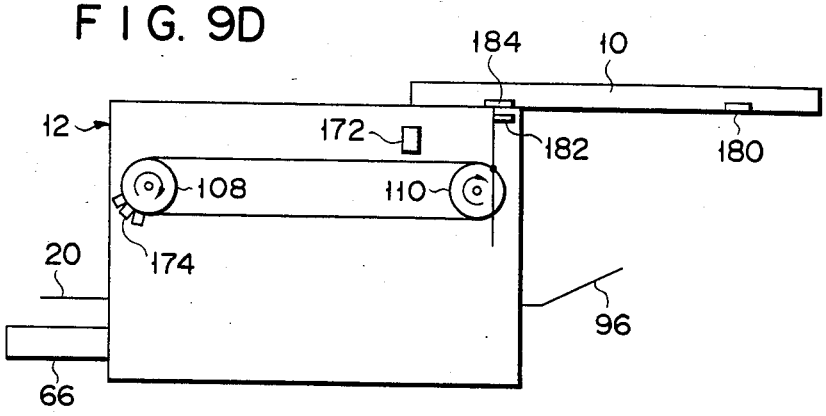
Figure 9E:
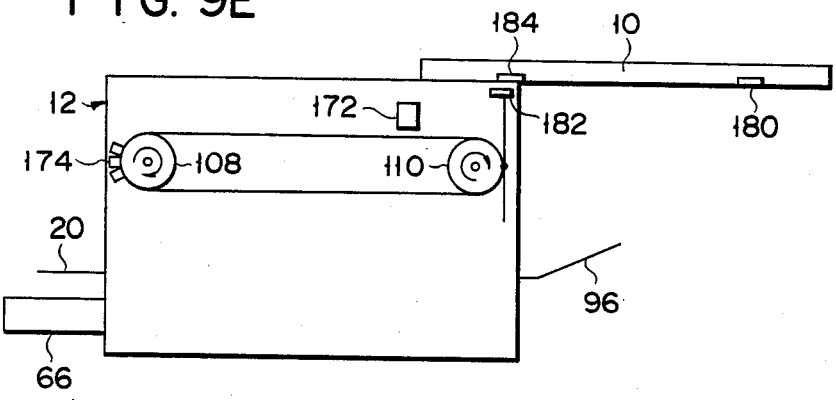
Figure 9F:
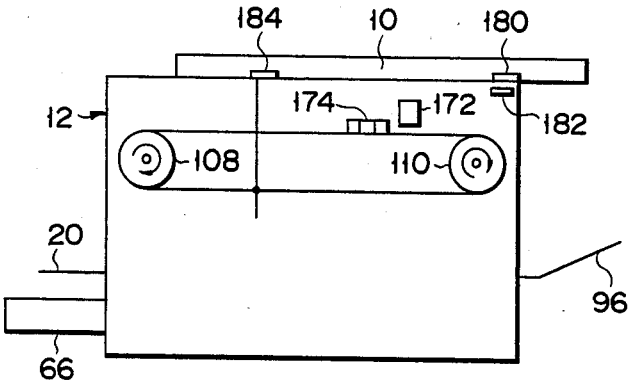
Figure 10A:
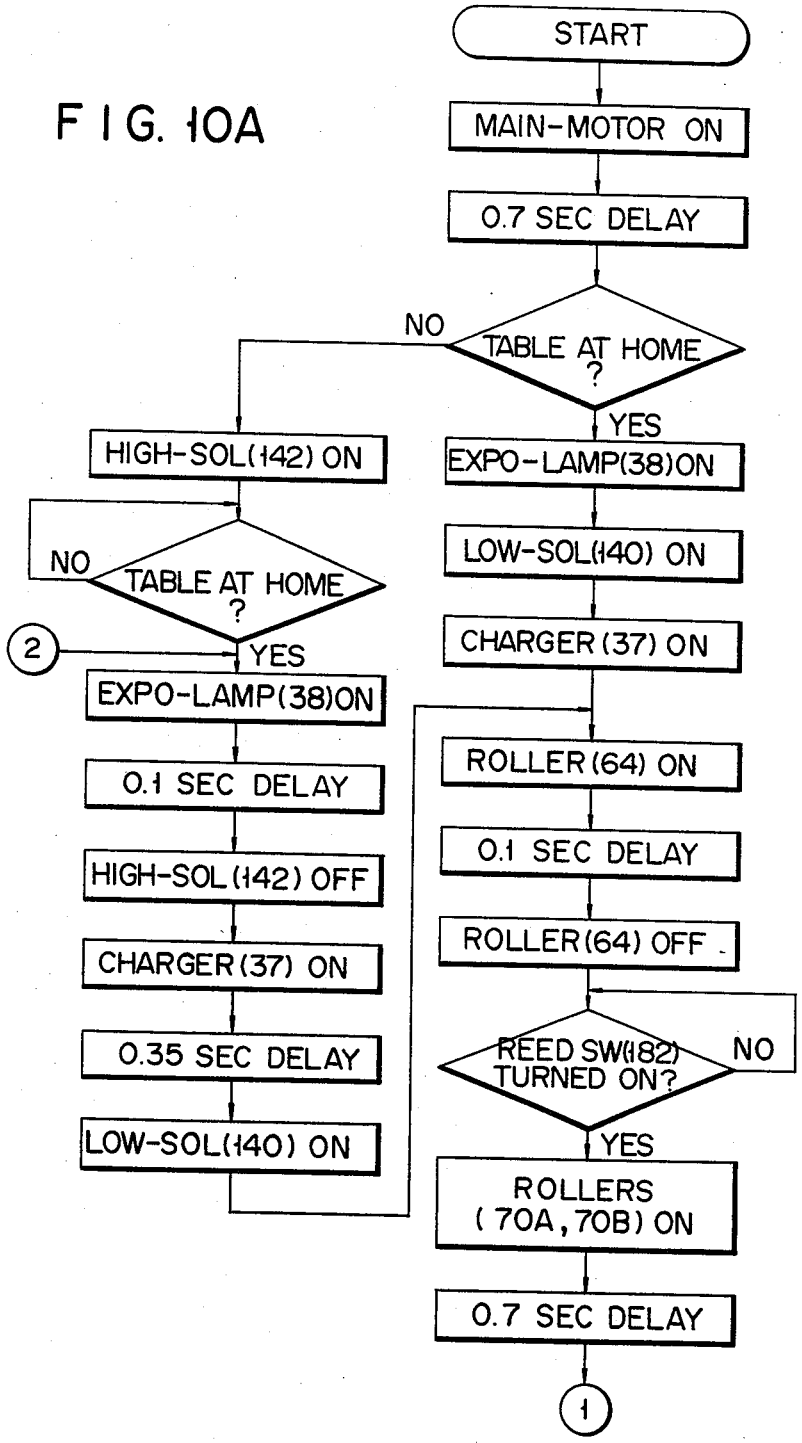
FIGS. 10A to 10B are flow charts of a program for use in the control circuit shown in FIG. 8.
Figure 10B:
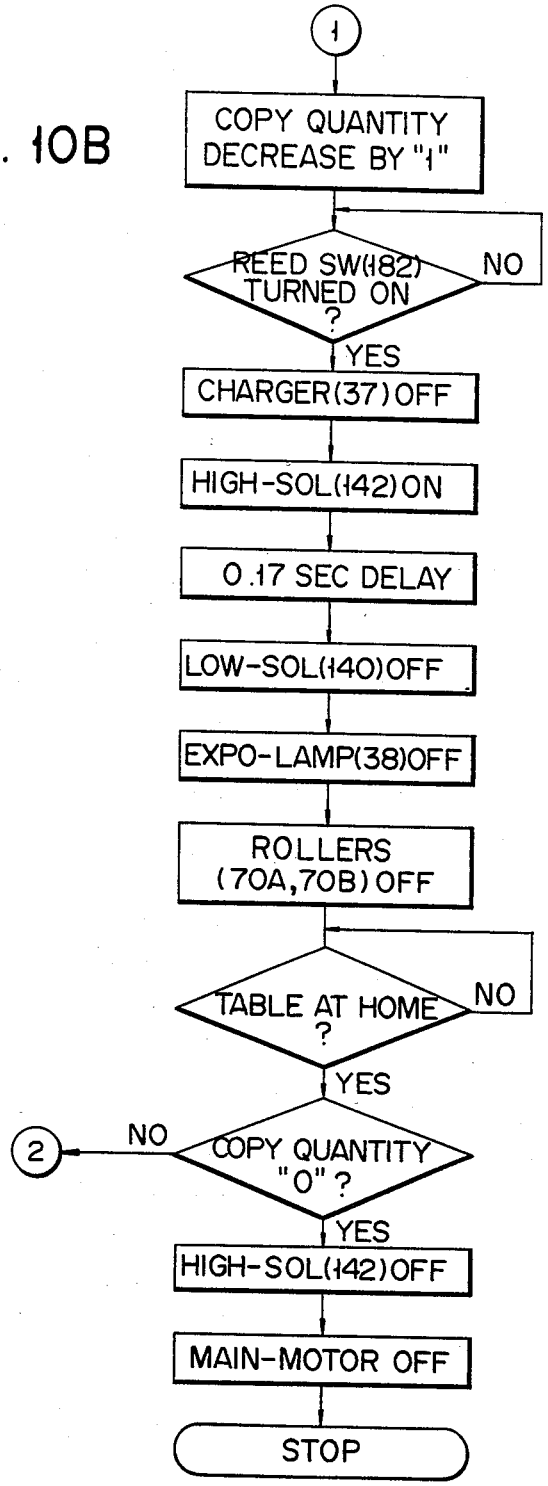

In a normal stand-by state, the document table 10 is located at its home position as shown in FIG. 9A. At this time, the shielding plates 174A, 174B and 174C are interposed between the magnet 176 and the reed switch 178 of the home switch assembly 172, whereby the reed switch 178 is kept open. When, at this stage of operation, the print key (FIG. 2) of the control panel 22 is pressed, the main motor 111, transfer charger, separating charger and developer are turned on. After the lapse of a warm-up period of time required for the warm-up of the main motor, e.g. 0.7 second, the microcomputer 186 checks the status of the reed switch 178, to find out whether or not the document table 10 is located at its home position. Since, at this stage of operation, the reed switch 178 is kept "off", the microcomputer 186 recognizes that the document table 10 is at the home position. Accordingly, the microcomputer 186 turns on the exposure lamp 38 and the solenoid (low speed solenoid) 140 through the driver 188. Upon energization of the solenoid 140, the plunger 144 is engaged with the spring clutch 132, whereby the power transmitted to the input gear through the gears 124, 126, 128 and 130 in the order mentioned is transmitted to the output gear of the spring clutch 132. At this time, the charging charger 37 is turned on. The output gear of the spring clutch 132 transmits its power to the chain 106 through the gears 136, 138 and the sprocket 110 in the order mentioned. Thus, the chain 106 is allowed to travel, and the document table 10 is moved backward at a low speed to the exposure start position shown in FIG. 9B. When the document table 10 reaches the exposure start position, that is, when the pin 104 reaches a dead point of the sprocket 108, the pin 104 is moved from the backward direction to the forward direction. At this time of this forward movement, the photoconductive drum is exposed to the light reflected from the document on the document table 10. During this exposure as well, the document table 10 continues to make its forward movement and, when the table reaches the paper start position shown in FIG. 9C, the magnet 180 closes the reed switch 182. When reed switch 182 closes, the microcomputer 186 causes a rotation of the aligning roller 64 for feeding to the transfer section the paper, which is previously picked up from cassette 16 by pick-up roller 64 during the time the table 10 is moving backward at a low speed. When the document table 10 is further moved to reach the high speed clutch actuate position shown in FIG. 9D, the magnet 184 closes the reed switch 182. In response to the closure of the reed switch 182, the microcomputer 186 energizes the solenoid 142 through the driver 188. Thus, the stopper pawl of the plunger 146 of the solenoid 142 is engaged with the ratchet gear of the spring clutch 134. The microcomputer 186 is previously programmed with a period of time (approximately 0.17 sec.) representing the time when the spring clutch 134 is engaged with the ratchet gear until the time when the power is reliably transmitted to the output gear 158 thereof. After the lapse of this period of time, the microcomputer 186 makes the solenoid 140 shut off to release the spring clutch 132. Thus, the chain 106 is allOwed to rotate at low speed until the input and output gear bosses of the spring clutch 134 are completely gripped by means of the clutch spring. When, thereafter, the pin 104 reaches the dead point of the sprocket 110, that is, when the document table 10 is moved up to its forward limit position, the spring clutch 134 is reliably made operative, and the document table 10 is backwardly moved at a high speed from the forward limit position. That is, the positions of the reed switch 182 and magnet 184 are set such that the period of time taken from the time when the reed switch 182 is turned on until the time when the pin 104 reaches the dead point of the sprocket 110 is equal to the response time of the spring clutch. When the document table 10 passes at high speed through the position shown in FIG. 9F to approach the position shown in FIG. 9A, the shielding plates 174A, 174B and 174C are again inserted into the space between the magnet 176 and the reed switch 178 of the home switch assembly 172, and the open signal of the reed switch 178 is supplied to the microcomputer 186. Where one copy is obtained, the solenoid 142 is turned off simultaneously with the receipt of the switch open signal, whereby the spring clutch 134 is released. After a little idle movement the document table 10 is thus allowed to stop at the home position shown in FIG. 9A. Where a plurality of copies are obtained, the microcomputer 186 turns the solenoid 142 off a while after its receipt of this switch open signal, thereby releasing the spring clutch 134. The document table 10 is thus allowed to stop after it is moved up to the start position shown in FIG. 9B. In the case of obtaining a plurality of copies, since the document table 10 is allowed to travel for the next copying stroke, not from the home position, but from the start position, the microcomputer 186 turns the solenoid 140 "on" after the lapse of the period of time corresponding to the difference of times for the document table 10 to move from the home position to the start position at high and low speeds. The document table is thereby allowed to start its movement for the next exposure in the same manner as mentioned above. The document table 10 moves up to the home position after its exposure for a final copy, and stops there.

When the document table 10 is not at the home position when commencing the copying operation, a switch close signal is supplied from the reed switch 178 of the home switch assembly 172 to the microcomputer 186. In response to this switch close signal, the microcomputer 186 turns the solenoid 142 "on" and causes the chain 106 to travel by the use of the force transmitted thereto through the spring clutch 134. The document table 10 is thereby allowed to move at high speed. When the document table 10 arrives at the home position, the reed switch 178 is opened and the microcomputer 186 is informed that the document table 10 has reached the home position. The image forming apparatus thus commences the above-mentioned copying operation after the document table 10 is restored as above to the home position.

As stated above, in the image forming apparatus according to the embodiment of the invention, the microcomputer 186 controls the solenoids 140 and 142 in response to the signals from the switch mechanisms. When this control is effected, the spring clutch 134 is given a start instruction during the period of time in which the document table 10 is allowed to move at a low speed by the force supplied thereto from the spring clutch 132. Then, the operation of the spring clutch 132 is stopped after the input and output gear bosses 154, 156 are firmly gripped by the clutch spring 148 of the spring clutch 134. At this time, the document table 10 is located at its forward limit position and is substantially given the power from the spring clutch 134, at this position. Accordingly, even when an external force is applied to the document table 10 at the time of switching the speed thereof, it is impossible for any abnormality to occur in the operation of the image forming apparatus. Further, according to this image forming apparatus, the load or burden which is imposed upon the spring clutches 132 and 134 is mitigated with the result that the service life thereof is extended.

Further, according to the present image forming apparatus, the home switch assembly 172 attached to the cabinet 12 detects that the document table 10 is at the home position, in cooperation with the shielding plates 174A, 174B and 174C attached to the chain 106, while the reed switch 182 attached to the cabinet 12 detects the exposure starting position, forward limit position, etc. of the document table 10, in cooperation with the magnets 180 and 184 attached to the document table 10. Therefore, the moving state of the document table 10 is detected with high precision, and it is possible to control the various parts or sections with high reliability.

In the above-mentioned embodiment, the magnet and reed switch were used in combination for the purpose of detecting the location of the moving document table 10. The invention is not limited thereto, but use may be also made of a magnet combined with a Hall element as well as of a microswitch which uses a photocoupler as an actuator. The attaching positions therefor may be suitably modified according to the situation involved.

The present invention is not limited to the abovementioned embodiment but may be reduced to practice by being modified in various forms without departing from the scope, or changing the subject matter, of the invention. For example, the invention is applicable to a facsimile and the like.

What is claimed is:

1. An image forming apparatus comprising:

a document table on which an original document is disposed and which is reciprocatingly movable;

an illuminating station for illuminating said original document;

reciprocating means having a chain to reciprocate said document table across the illuminating station in accordance with the traveling of said chain;

a drive source for generating a drive force;

coupling means for connecting said drive source to said reciprocating means and including at least first and second spring clutches to drive said chain in one direction at first and second speed modes;

control means for changing said first speed mode to said second speed mode by actuating said second spring clutch while said first spring clutch is continuously activated and then deactuating said first spring clutch after a predetermined period has elapsed from the actuation of said second spring clutch, said predetermined period corresponding to the actuation response time of said second spring clutch; and image processing means for producing a replica through slit exposure by movement of the document table in accordance with the image of the original document.

2. An image forming apparatus according to claim 1, wherein said control means includes a detector for detecting that said document table has reached a predetermined position, a first section for actuating said second spring clutch in response to a detection signal of said detector, and a second section for deactuating said first spring clutch after said predetermined period has elapsed from the receipt of said detection signal.

3. An image forming apparatus according to claim 2, wherein said detector has plate means attached to said chain and sensing means which is disposed to sense said plate means when said document table is located in said predetermined position.

4. An image forming apparatus according to claim 1, wherein said control means includes a detector for detecting that said document table has reached a predetermined position from which said document table moves to a stroke end position upon the elapse of said predetermined period, a first section for actuating said second spring clutch in response to a detection signal of said detector, and a second section for deactuating said first spring clutch after said predetermined period has elapsed from the receipt of said detection signal.

5. An image forming apparatus according to claim 4, wherein said detector has a magnet attached to said document table and sensing means which is disposed to sense said magnet when said document table is located in said predetermined position.

6. An image forming apparatus according to claim 5, wherein said sensing means is a reed switch operable by said magnet.

7. An image forming apparatus according to claim 5, wherein said sensing means is a Hall element operable by said magnet.

* * * * *